US011394096B1

(12) United States Patent
Johnson et al.

(10) Patent No.: US 11,394,096 B1
(45) Date of Patent: Jul. 19, 2022

(54) WAVEGUIDE SYSTEM AND THE MANUFACTURABILITY THEREOF

(71) Applicants: Ray M. Johnson, Shady Cove, OR (US); Ray Kniffen, Jr., White City, OR (US)

(72) Inventors: Ray M. Johnson, Shady Cove, OR (US); Ray Kniffen, Jr., White City, OR (US)

( * ) Notice: Subject to any disclaimer, the term of this patent is extended or adjusted under 35 U.S.C. 154(b) by 0 days.

(21) Appl. No.: 16/904,100

(22) Filed: Jun. 17, 2020

Related U.S. Application Data

(60) Provisional application No. 62/862,575, filed on Jun. 17, 2019.

(51) Int. Cl.
*H01P 3/12* (2006.01)
*H01P 1/39* (2006.01)
*H01P 1/19* (2006.01)

(52) U.S. Cl.
CPC . *H01P 1/39* (2013.01); *H01P 1/19* (2013.01)

(58) Field of Classification Search
CPC ..... H01P 1/11; H01P 1/39; H01P 3/12
See application file for complete search history.

(56) References Cited

U.S. PATENT DOCUMENTS

| | | | | | |
|---|---|---|---|---|---|
| 3,925,883 | A * | 12/1975 | Cavalear | H01P 11/00 | 29/600 |
| 4,591,088 | A * | 5/1986 | Mulliner | C23C 18/22 | 228/121 |
| 4,916,414 | A * | 4/1990 | Ranghelli | H01P 1/397 | 333/1.1 |
| 5,003,321 | A * | 3/1991 | Smith | H01Q 5/45 | 343/781 R |
| 5,398,010 | A * | 3/1995 | Klebe | H01P 11/002 | 156/150 |
| 6,239,418 | B1 * | 5/2001 | Konig | C04B 41/009 | 219/690 |
| 6,407,646 | B1 | 6/2002 | Johnson | | |
| 8,941,447 | B2 | 1/2015 | Johnson | | |
| 2012/0161895 | A1 | 6/2012 | Johnson | | |

* cited by examiner

*Primary Examiner* — Dean O Takaoka
(74) *Attorney, Agent, or Firm* — Beeson Skinner Beverly, LLP

(57) ABSTRACT

In a waveguide system that includes a bifurcated ferrite loaded waveguide section, the waveguide used for at least the bifurcated ferrite loaded waveguide section, and preferably the waveguides for each of the other components of the waveguide system, is provided in the form of an aluminum waveguide part, or a part of another material having comparable properties, most suitably in the form of an aluminum casting. The aluminum part is either entirely or at least partially copper plated and preferably includes aluminum waveguide flanges.

17 Claims, 9 Drawing Sheets

WAVEGUIDE SYSTEM AND THE MANUFACTURABILITY THEREOF

CROSS-REFERENCE TO RELATED APPLICATIONS

This application claims the benefit of U.S. Provisional Patent Application No. 62/862,575 filed Jun. 17, 2019, which is incorporated herein by reference.

BACKGROUND

The present invention generally relates to waveguide systems, and more particularly to high power waveguide systems that use bifurcated ferrite loaded waveguide sections to alter the phase relationship of the microwave power entering and exiting the ferrite section as it passes through parallel stacked waveguides of the bifurcated guide. The invention more particularly relates to the manufacture of waveguide systems that use bifurcated ferrite loaded guides and overcoming the problems associated with the use of traditional materials in the fabrication of the system components.

Waveguide systems that can advantageously use bifurcated ferrite loaded waveguide sections include three-port circulators such as described in U.S. Pat. No. 6,407,646 and pulse power switching systems such as described in U.S. Pat. No. 8,891,447. The waveguides used in these systems are typically fabricated of a copper alloy which provides highly conductive waveguide walls and good thermal conductivity. Waveguide flanges, typically made of brass, are brazed to the ends of the guides so that the different components of the system can be attached to one another and to external components or loads. However, there are drawbacks to using these materials. The drawbacks include the fact that copper is a relatively heavy material resulting in systems that are difficult to lift and hold in place in their operating environments. Copper is also expensive, contributing significantly to the cost of the systems. Still further, having to braze the waveguide flanges onto the ends of the waveguide components complicates the fabrication process, further increasing costs.

The present invention overcomes the drawbacks of using traditional materials in waveguide systems by a unique substitution of material and methodology for fabricating the waveguide systems so that they achieve operational functionality comparable to waveguide systems fabricated of traditional materials.

SUMMARY OF INVENTION

The invention is directed to the fabrication of a waveguide system, and particularly a waveguide system that includes a bifurcated ferrite loaded waveguide section, such as described in U.S. Pat. Nos. 6,407,646 and 8,891,447 issued to Ray M. Johnson, both of which are incorporated herein by reference. In accordance with the invention, the waveguide used for at least the bifurcated ferrite loaded waveguide section and preferably the waveguides (sometimes referred herein as simply "guides") for each of the other components of the waveguide system, is provided in the form of an aluminum waveguide part (or a part of another material having comparable properties), and most suitably in the form of an aluminum casting. The aluminum part is either entirely or at least partially copper plated as herein described and preferably includes aluminum waveguide flanges. Also, the aluminum flanges and the aluminum waveguide parts can be provided as a single unitary part, e.g. as an aluminum casting, thereby eliminating the need to separately attach the flanges to the ends of the guide by a separate step such as by brazing.

As to the bifurcated ferrite loaded waveguide section of the waveguide system, at least the inside guidewalls of the aluminum waveguide part are copper plated; however, preferably both the outside and inside guidewalls are copper plated. The copper plating on the inside of the guidewalls will provide the walls with suitable electrical conductivity to allow microwave power to be propagated down the guide without significant resistive losses. The inside guidewalls will preferably be plated with a copper coating at least about 2 mils thick, preferably using an electroplating process. Electroplating will ensure coverage over all surfaces of the inside guidewalls.

The steel web plate used to bifurcate the ferrite loaded waveguide section and which is needed to shunt DC magnetic fields applied from the top and bottom broadwalls of the waveguide as later described is also copper plated. Copper plating of this web plate provides conductive surfaces to support propagation of the EM fields in the bifurcated guides and provides a suitable surface material for soldering the web plate to the guidewalls.

The method of fabricating the above-described ferrite section of the waveguide system in accordance with the invention includes creating an aluminum part (or part of another comparable material) in the form of a waveguide having a top wall, a bottom wall and sidewalls extending between the top and bottom walls, machining the part, broaching the sidewalls of the waveguide formed by the aluminum part to create opposed shallow broached grooves in the sidewalls of the waveguide, plating at least the guidewalls of the aluminum part and the web plate, placing the web plate in the guide using the guide's shallow broached grooves to hold the guide in position before soldering, and soldering the web plate to the sidewalls of the waveguide. Thereafter, copper waterlines can be soldered to the outside of the waveguide and ferromagnetic strips affixed to the top and bottom walls of the waveguide.

DESCRIPTION OF ILLUSTRATED EMBODIMENT

Figure 1:
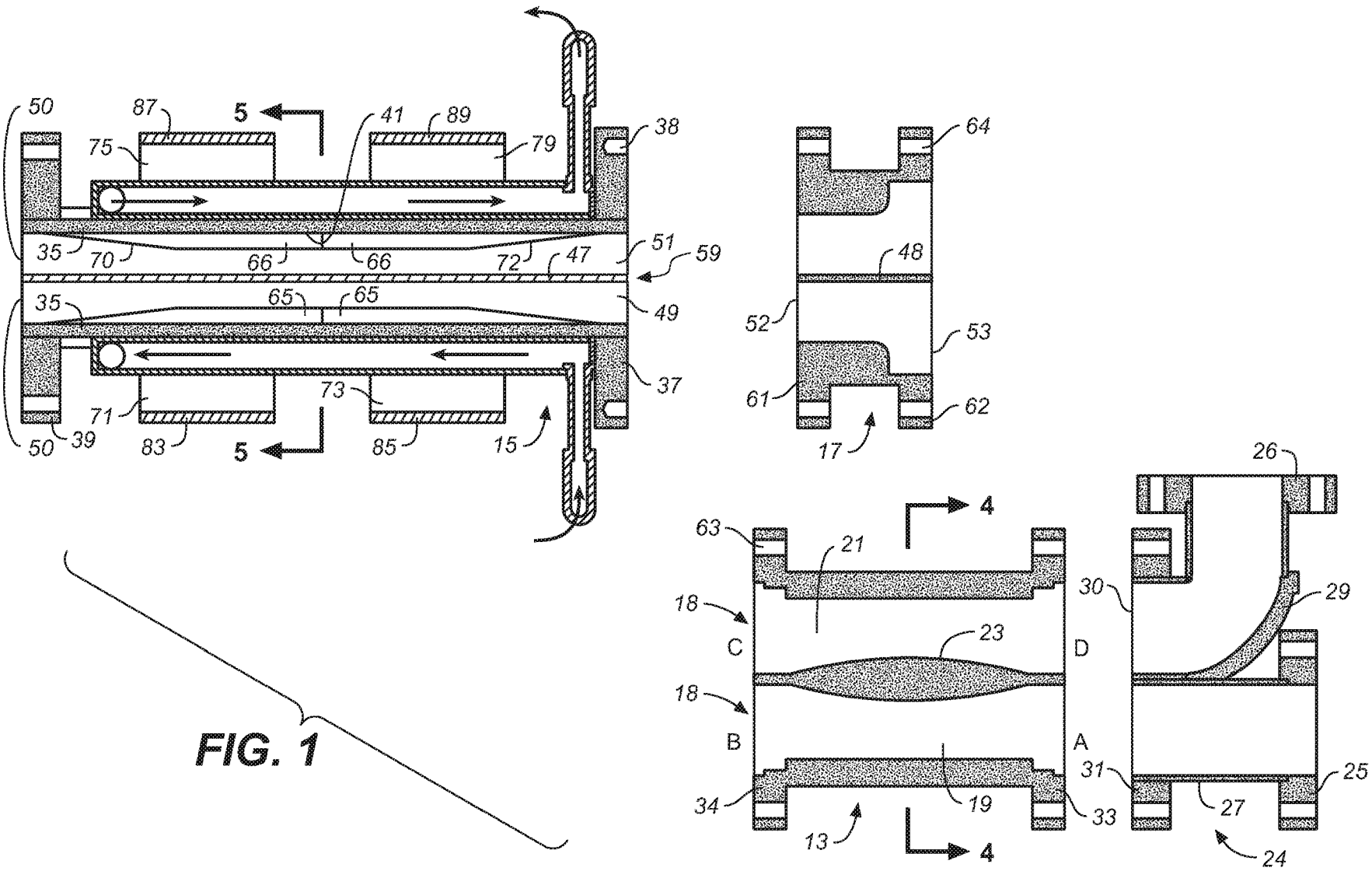
FIG. 1 is an exploded cross-sectional view of a distributed three port waveguide circulator showing the different waveguide components of this waveguide system that can be fabricated of copper plated aluminum parts such as castings in accordance with the invention.

The invention described herein is described in reference to a waveguide circulator having a bifurcated ferrite loaded waveguide section; however, it will be understood that the invention is not intended to be limited to waveguide circulators. The described manufacturing methods could also be used in the manufacture of other waveguide systems comprised of a bifurcated ferrite loaded waveguide section, such as microwave switches. However, before describing the novel method of manufacturing a distributed three-port waveguide circulator in accordance with the invention, the general design aspects and operation of the circular are described with reference to FIGS. 1-4 of the drawings.

Three-Port Circulator

FIGS. 1-4 show a distributed three-port waveguide circulator 11 having an input waveguide coupler section 13, an elongated bifurcated waveguide section 15 and a separate transformer section 17 (a step transformer) for coupling the coupler output 18 of the waveguide coupler section to the bifurcated waveguide section. The waveguide circulator is additionally seen to have three ports, identified as Port 1, Port 2, and Port 3. In a typical application, a microwave power source (not shown) is attached to Port 1 for introducing microwave power into the waveguide coupler section 13 at the front end of the circulator. (For high power applications, the power source would suitably be a magnetron or klystron.) The microwave power introduced at this port is propagated through the circulator as hereinafter described until it arrives at Port 2 of the circulator which, again in a typical application, delivers the microwave power to a microwave load such as a linear accelerator. Reflected power from the microwave load is in turn propagated back through the circulator and emerges from Port 3. A power absorbing waveguide load (not shown), which is most suitably a matched load such as a water load designed as described in U.S. Pat. No. 4,516,088, can be attached to Port 3 to absorb the reflected power. In this manner, the microwave source attached to Port 1 of the circulator is isolated from the microwave load fed from Port 2.

The input waveguide coupler section 13 of the circulator is suitably a three db (hybrid) top wall waveguide coupler having a first full height rectangular waveguide portion 19 providing a first waveguide path and a second full height waveguide rectangular portion 21 providing a second waveguide path. An apertured common wall portion 23 couples the first waveguide path to the second waveguide path, and terminals A, B, C and D (shown in FIG. 2) define the ends of the waveguide paths. In accordance with the well-known theory of waveguide couplers, a portion of the apertured common wall of the coupler is removed around a plane of symmetry running the length of the adjacent waveguide paths of the coupler to permit coupling between the two waveguide paths such that divided power traveling along one of the waveguide paths is ninety degrees out of phase relative to power traveling along the other guide. In a hybrid (3 db) coupler, power divides substantially equally between the two guides. More specifically, power inputted at terminal A of hybrid coupler 13 will be divided equally between the two output terminals B and C forming coupler outputs 18 where the two components of the power from Port 1 will be phase shifted by ninety degrees.

It can be seen that Port 1 of the circulator is associated with terminal A of the hybrid coupler and Port 3 with terminal D. These ports are located at the diverging ends of short port waveguides 27, 29 having waveguide flanges 25, 26. A large common waveguide flange 31 is provided at the back end 30 of these short port guides for connecting the guides to a similarly sized flange 33 at the front end of the hybrid coupler. Taken together, short port guides 27, 29 and their associated waveguide flanges 25, 26 and 31 make up a front-end waveguide section 24, which as later described can, in accordance with the invention, be constructed of a single part, which is most suitably a cast part. The upper port guide 29 associated with Port 3 can be curved upward in a 90 degree bend as shown in FIGS. 1 and 2 or can have other curved configurations such as later described to accommodate space limitations imposed by particular applications of the circulator.

Figure 2:
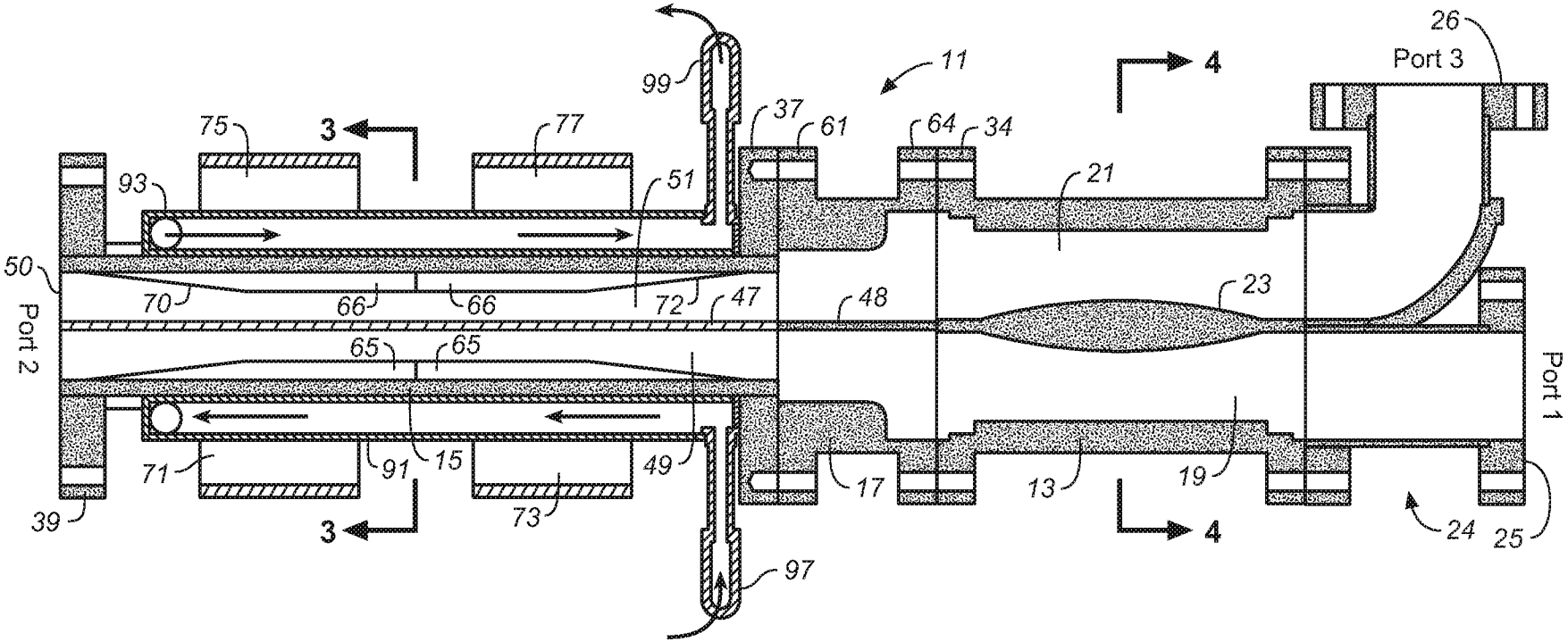
FIG. 2 is a cross-sectional view of a distributed three-port waveguide circulator showing the component parts of the circulator shown in FIG. 1 in their assembled state.
Figure 4:
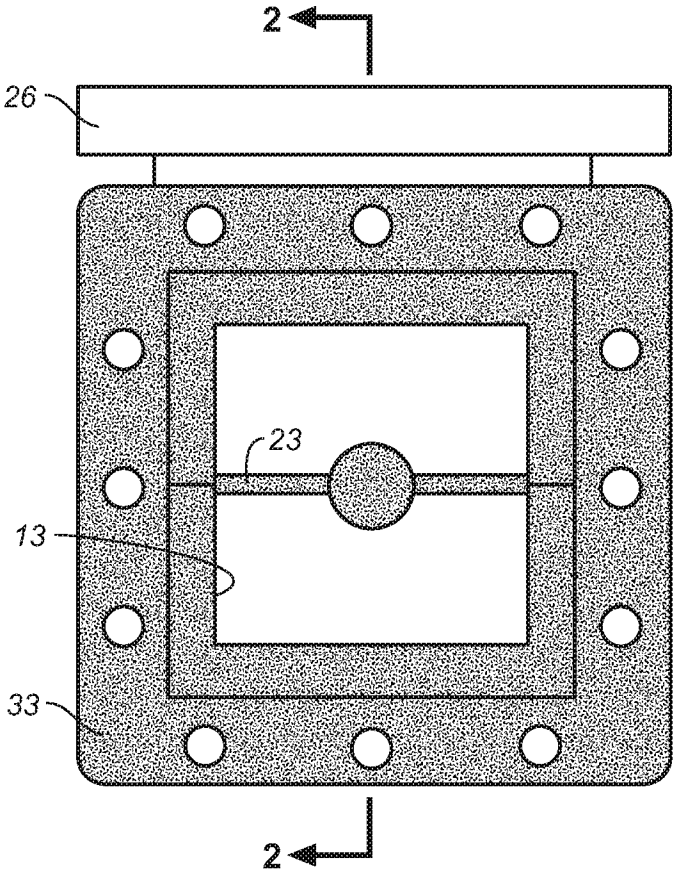
FIG. 4 is a cross-sectional view thereof taken along lines 4-4 in FIG. 2.
Figure 3:
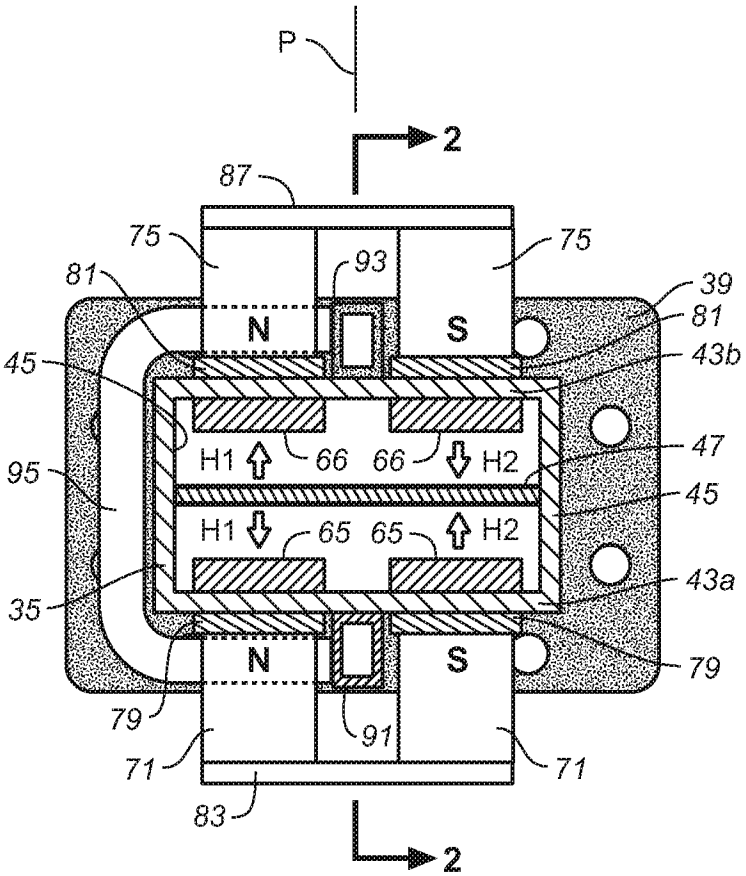
FIG. 3 is a cross-sectional view thereof taken along lines 3-3 in FIG. 2.

Referring to FIGS. 1-3, it can be seen that the bifurcated waveguide section 15 of waveguide circulator 11 includes an elongated section of waveguide 41 terminated by waveguide flanges 37, 39. In the illustrated embodiment, the waveguide section 41 is a standard size full height rectangular waveguide which corresponds in size to the first and second full height rectangular waveguide portions 19, 21 of the waveguide coupler section 13. As seen in FIG. 3, the rectangular guide of this section has upper and lower outer broadwalls 43*a*, 43*b*, and side walls 45 and is bifurcated by a longitudinally extending transverse web plate 47. The web plate runs parallel to the broadwalls and is seen to divide the waveguide section into stacked reduced height waveguides 49, 51, which provide dual reduced height waveguide paths downstream of the waveguide coupler. The height of each of these stacked reduced height guides is approximately one-half the full guide height for the bifurcated section (one half the full guide height less one half the thickness of the web plate), and thus, approximately one-half the guide height of the waveguide paths 19, 21 of the circulator's coupler section 13. The step transformer section 17 interposed between the waveguide coupler section and the bifurcated waveguide section provides a means for stepping down from the full height guides to the half-height guides with minimal power reflection. More specifically, the full height end 53 of transformer section 17 is connected to the hybrid coupler output 18 of the coupler section 17 by means of waveguide flanges 34, 62. At the other end of the transformer section, the reduced height transformer end 52 is connected to the bifurcated input end 59 of the bifurcated waveguide section by means of flanges 37, 61. As in any conventional waveguide system, the waveguide flanges are secured together by suitably sized flange bolts (not shown) inserted through the flange bolt holes, such as bolt holes 63, 64 of mating flanges 34, 62 of the waveguide coupler and transformer sections. It is noted that the bolt holes 38 in flange 37 at the input end of the bifurcated waveguide section can be suitably threaded tap holes to eliminate the need for nuts at the back of the flange, thereby providing more room to accommodate the water cooling lines, such as the water cooling lines 97, 99 shown in FIGS. 1 and 2.

As best shown in FIGS. 1 and 2, web plate 47 of the bifurcated waveguide section 15 extends for a distance beyond the guide's bifurcated input end 59 so as to provide a bifurcated transformer section having two waveguide paths corresponding to the waveguide paths provided by first and second full height waveguide sections 19, 21 of coupler section 13. As later described, this extension can be provided in the step transformer 17 itself.

It can therefore be seen that two parallel waveguide paths are provided through the circulator, one path extending from Port 1 to Port 2 comprised of the first or lower waveguide portion 19 of the waveguide coupler 13 and the lower reduced height waveguide 49 of the bifurcated waveguide section, and the other comprised of the second or top waveguide portion 21 of the waveguide coupler and the reduced height waveguide 51 of the bifurcated guide. Relative phase shifting of the microwave power as it travels along these waveguide paths must be achieved in order to deliver the maximum available power to the microwave load at Port 2 and to divert any reflected power back to the waveguide termination at Port 3. This relative phase shifting is achieved by the non-reciprocal properties of the waveguide paths in the circulator's bifurcated waveguide section 15.

The Ferrite Loaded Bifurcated Waveguide

Referring again to FIGS. 2 and 3, each of the reduced height waveguides 49, 51 of the bifurcated waveguide section is loaded with a non-reciprocal ferrite material, in the form of ferrite strips 65, 66, which are attached, such as with suitable bonding material, to inner conductive surfaces 67, 69 of the guide's outer broadwalls 43*a*, 43*b*. In each of the reduced height guides, the ferrite strips are arranged in pairs positioned symmetrically about the guide's vertical center plane P. Placement of the ferrite strips relative to the center plane P will affect the degree of phase shift achieved in the bifurcated waveguide section. (The greatest phase shift can be achieved by placing the ferrite strips slightly closer to the guide's side walls 45 than to the center plane.)

To achieve the desired non-reciprocal phase shift properties of the ferrite strips, a static magnetic field is provided in the reduced height waveguides by means of a magnetic circuit associated with the bifurcated waveguide section which produces oppositely directed magnetic fields through the ferrite strips as generally shown by magnetic field direction arrows F1 and F2 shown in FIG. 3. In this case the magnetic circuit includes two pairs of bar magnets 71, 73 on the bottom of the bifurcated guide 15 and two pairs of permanent bar magnets 75, 77 on the top of the guide. The bar magnet pairs on the bottom of the guide are placed on two elongated pole plates 79 which longitudinally extend in parallel relation along the bottom broadwall 43*a* of the bifurcated waveguide; similarly, the permanent magnet pairs 75, 77 are positioned in spaced relation along parallel steel pole piece plate pairs 81 longitudinally extending along the waveguide's top broadwall 43*b*. Each of the permanent magnet pairs 71, 73, 75, 77 additionally includes a bridge plate 83, 85, 87, 89 which spans and provides a magnetic flex path between the permanent magnets of each permanent magnet pair. The assembly of the permanent magnets, pole plates, and bridge plates can be secured and positioned on the bifurcated waveguide section by mechanical means (not shown), such as metal straps wrapped circumferentially around the assemblies or steel bars secured longitudinally across the tops of the assemblies between the guide's waveguide flanges 37, 39, suitable brackets, or by adhesive means alone or in combination with mechanical means. As an alternative to permanent magnets, electromagnets could be used.

Referring to FIG. 3, it can be seen that the magnetic circuit includes the center web plate 47 which bifurcates the rectangular guide 41 of bifurcated waveguide section 15 into the upper and lower reduced height waveguides 49, 51. To provide a path for the magnetic flux as well as surface conductivity for the microwave power travelling through the reduced height guides, the center web plate is most suitably fabricated of steel which is copper plated to provide a conductive surface. In a WR284 waveguide size, the copper plated steel web plate can suitably have a thickness of about 2-3 mils.

Use of Copper Plated Parts

It is seen that the three-port waveguide circulator illustrated in FIGS. 1-4 is made up of four waveguide components having waveguide flanges for connecting these components together and for connecting an external microwave power source and loads to the circulator. The components consist of a front-end waveguide section 24 providing Ports 1 and 3, a coupler section 13 (suitably a 3 db hybrid coupler), a waveguide transformer section 17 (suitably a step transformer), and a bifurcated ferrite section 15 with its center web plate 47. Conventionally, these four components would be fabricated of copper waveguides and brass flanges brazed to the ends of the guides, all of which are relatively heavy materials. In accordance with the invention, these sections are instead fabricated of parts that are copper plated. Preferably, the parts are cast parts, however, the parts could be fabricated by other fabrication processes, such as an extrusion process.

The material for the part is most suitably aluminum. In addition to being light weight, aluminum as the material of choice offers a number of advantages. First, it can be easily cast or extruded. It is also strong and easily machined, and it has good thermal as well as electrical conductivity properties. However, it is not intended that the invention be limited to the use of aluminum parts. Other materials capable of being copper plated could be used, however, they may not provide all the advantages of aluminum.

Figure 5A:
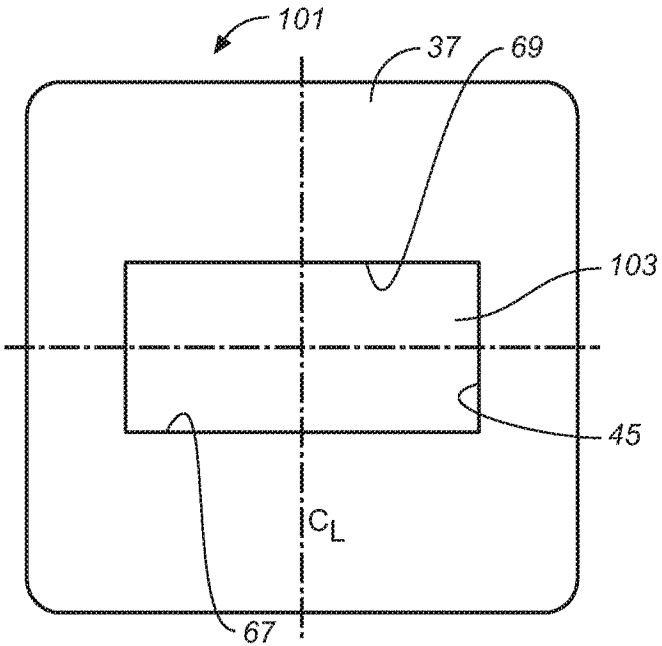
FIG. 5A is an end elevational view thereof.
Figure 5:
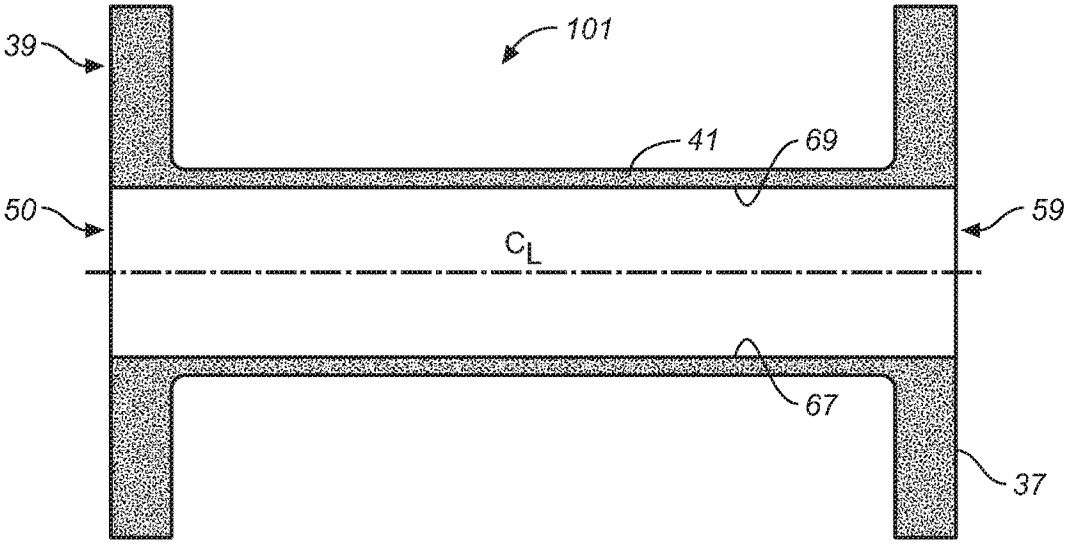
FIG. 5 is a cross-sectional view in side elevation of a raw aluminum part for the bifurcated ferrite loaded waveguide section of the circulator shown in FIGS. 1-4.

An embodiment of the invention using a cast part is now described with reference to FIGS. 5-7. FIGS. 5-7 illustrate a sequence by which a raw casting can be turned into the bifurcated ferrite section of the circulator described above. FIGS. 5 and 5A show a raw casting 101, again most suitably an aluminum casting, for the ferrite waveguide section of the circulator. The casting is a single unitary piece that provides in a single casting a length of waveguide corresponding to the full height waveguide 41 of bifurcated waveguide section 15 of the above-described circulator and the required waveguide flanges 37, 39 at the ends of the waveguide. The cast waveguide, which extends entirely through the casting, exits the guide at guide openings 50, 59. For a WR284 sized waveguide, the thickness of both the cast broadwalls and the narrow walls of the guide can suitably be 0.20 inches and the thickness of the cast flanges can suitably be 0.5 inches. For efficient cooling of the ferrite strips, the inside surfaces 67, 69 of the broadwalls of the waveguide should be flat to allow ferrite strips to be held firmly against the inside of the waveguide broadwalls by thin films of a heat conductive adhesive, such as a heat conductive epoxy, without air bubbles or gaps. The raw casting shown in FIGS. 1-5 is ready for machining, which is the next step in the process. The machining step takes place before casting can be copper plated.

Figure 6A:
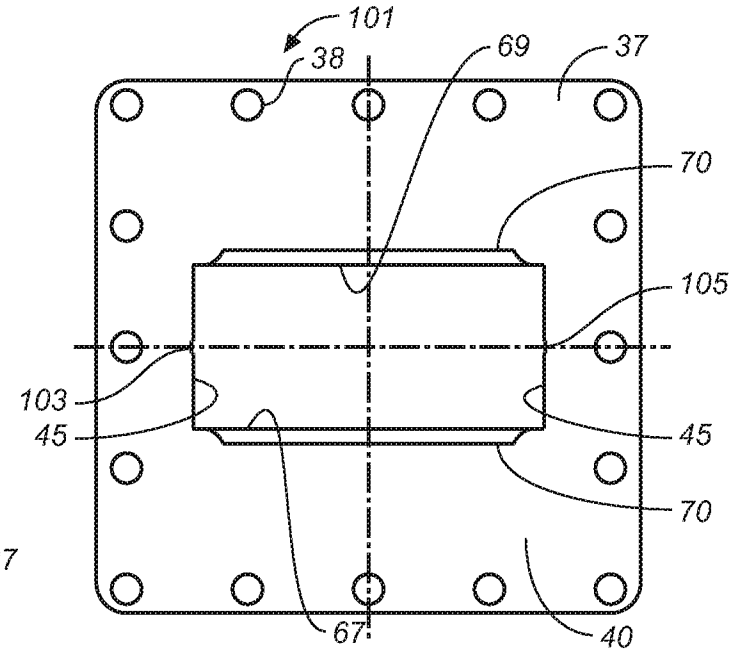
FIG. 6A is an end elevational view thereof.
Figure 6:
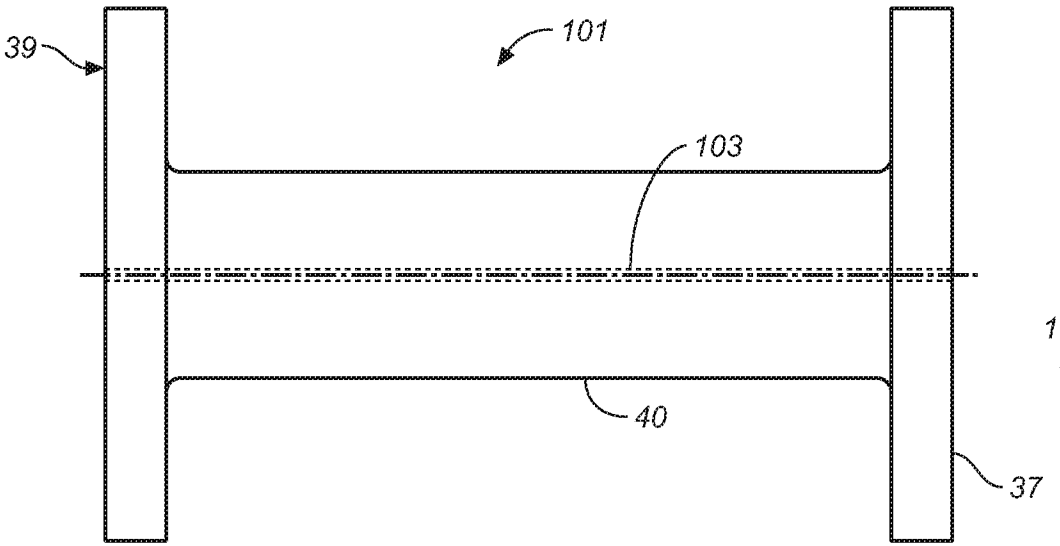
FIG. 6 is a cross-sectional view in side elevation of the part shown in FIG. 5 after it has been machined and broached, but prior to electroplating.

FIGS. 6 and 6A show the casting 101 after it has been machined but before it has been copper plated. Machining includes facing the waveguide flanges 37, 39 at the ends of the casting to produce flat flange faces 40 perpendicular to the waveguide axis, and drilling or tapping holes 38 in flanges 37, 39. The machining step also includes broaching the waveguide sidewalls 45 to create shallow broached grooves 103, 105 in the sidewalls midway between the waveguide's broadwalls 67, 69. The depth of the broached grooves can suitably be about 30 mils. The size of the broached grooves need only be large enough to retain the center web plate of the ferrite section in place while it is soldered.

In addition to the above machining operations, the outside guidewalls of the waveguide portion of the casting can be machined to provide the casting with a finished look. Also, the edges of the broadwalls at the ends of the waveguide can be machined to provide radiuses 70 at these edges to mitigate the effect of sharp knife-edge transitions between the reduced height guides 52 of the transformer section 17 and the bifurcated input end 59 of the bifurcated waveguide section 15.

Figure 7A:
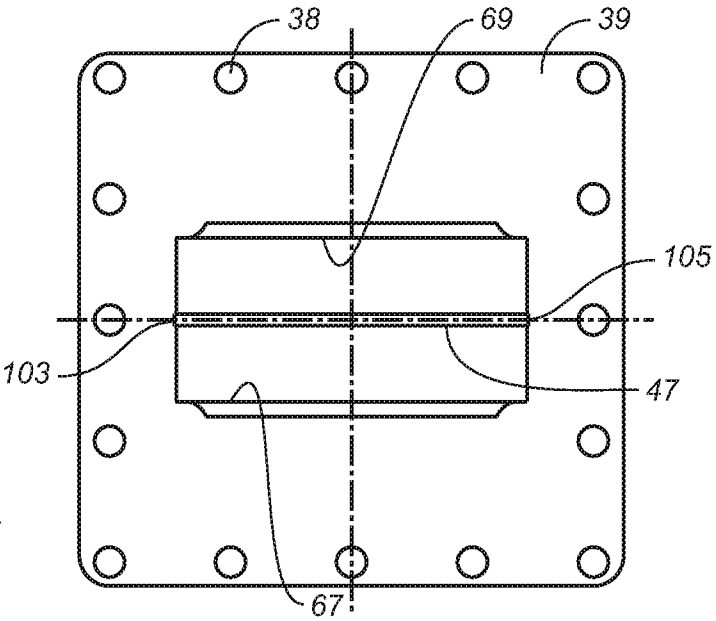
FIG. 7A is an end elevational view thereof.
Figure 7:
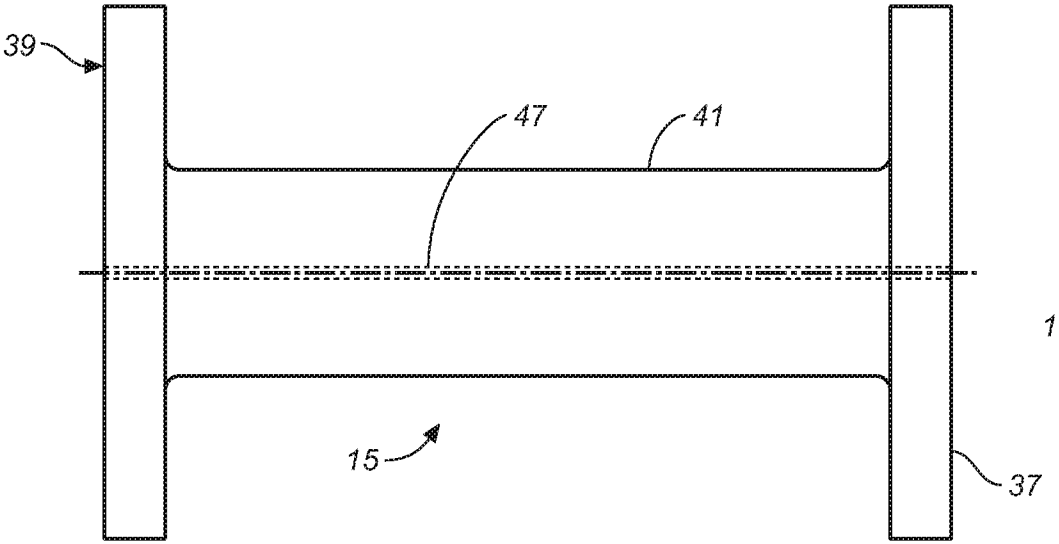
FIG. 7 is an end elevational view thereof showing the part after the copper plated web plate has been inserted and soldered in place in the waveguide section of the part.

FIGS. 7 and 7A show the casting 101 after it has been machined and copper plated and after the center web plate 47 has been soldered in place. To arrive at this final state, the machined casting shown in FIGS. 6 and 6A must first be copper plated. Preferably, the entire casting would be copper plated; however, to function properly, only the inside walls of the waveguide, including the extension of the guide through the flange ends, needs to be copper plated. (Copper plating the outside of the waveguide will allow copper cooling tubes to be easily soldered to the outside surfaces of the guidewalls.) The copper plating would suitably be about 2 to 3 mils in depth, as skin currents induced in the guidewalls are unlikely to exceed this depth. Copper plating is preferably applied by an electroplating process to ensure coverage is achieved over the entirety of the inside guidewall surfaces.

Again, the cast part illustrated in FIGS. 5-7, which forms the flanged waveguide component of the ferrite loaded section, is most suitably an aluminum casting. Suitably, the aluminum for this casting is a 363 aluminum alloy, which is a particularly good casting material that would not have to be heat treated. An A356 aluminum alloy heat treated to a T6 temper might also be used. However, a regular A356 aluminum that has not been heat treated could be used for the casting of other components of the waveguide system that do not experience the thermal loads experienced in the ferrite loaded section. The above-mentioned aluminum grades are exemplary and are not intended to be limiting as to the grades of aluminum that could be used for the casting.

As mentioned above, the steel center web plate 47 of the ferrite section of the circulator will also be copper plated. Once both the casting and the web plate have been copper plated, the web plate can be inserted into the waveguide formed by the casting by lining up the edges of the web plate with broached grooves 103, 105 and sliding the web plate in place. As above-mentioned, the broached grooves serve to hold the web plate in position while the plate is being soldered.

After the web plate has been soldered in place, the ferrite strips are attached to the opposite broadwalls of the waveguide, again suitably using a heat conductive epoxy. Heat generated in the ferrite strips can be efficiently conducted away from the guide by water cooling lines soldered to the outside of the guide, such as the cooling lines 97, 99 shown in FIGS. 1-2.

Thus, the steps of fabricating a finished ferrite section from a casting or other part in accordance with the invention include 1) producing a part, preferably an aluminum casting, in the form of a waveguide section having waveguide flanges, 2) machining the part, 3) broaching sidewalls of the waveguide extending through the waveguide section, 4) copper plating all or relevant portions of the part and the web plate, 5) soldering the web plate in the waveguide of the part, and 6) attaching ferrite strips to the broadwalls of the waveguide of the part.

Figure 8:
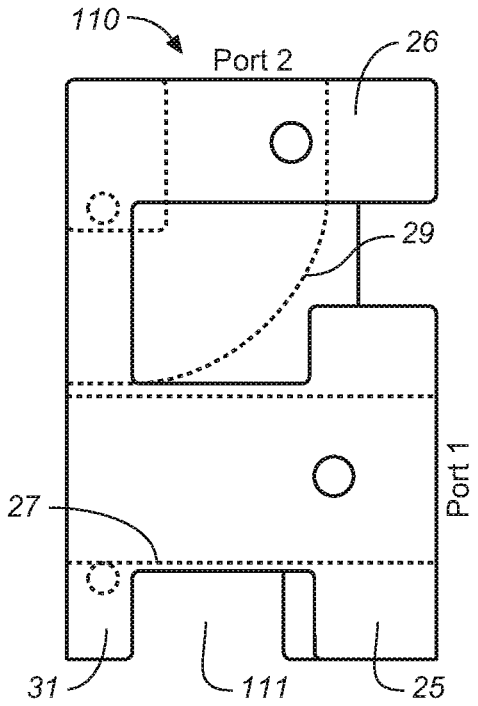
FIG. 8 is a side elevational view of an exemplary machinable part that can be used for the two-port end section (Ports 1 and 3) of the waveguide circulator shown in FIGS. 1-4 wherein the Port 3 connector waveguide has a 90 degree bend.
Figure 8A:
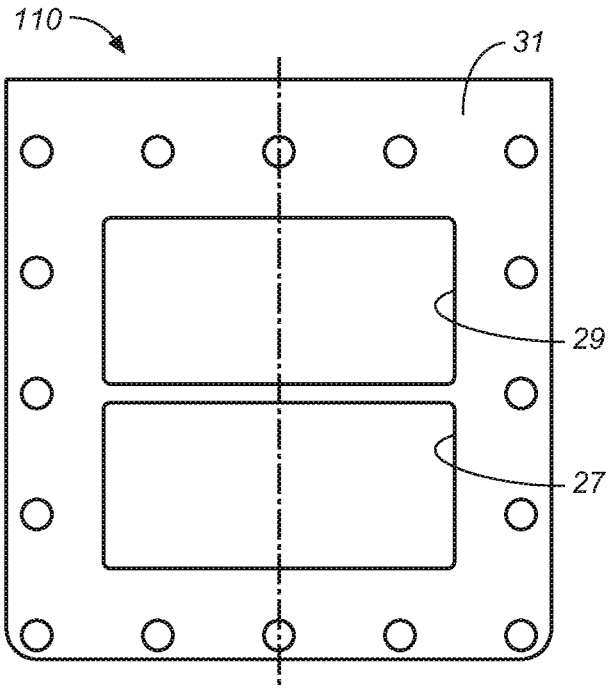
FIG. 8A is an end elevational view thereof.
Figure 8B:
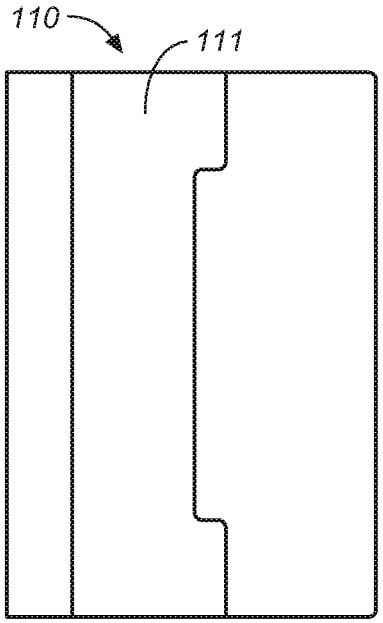
FIG. 8B is a bottom plan view thereof.

The other components of the waveguide circulator described above can similarly be fabricated from copper plated castings or parts. FIGS. 8, 8A and 8B show an example of a single casting 110 that can be used for the front-end section 24 of the circulator. Here, the full height port guides 27, 29 that terminate at Port 1 and Port 3 correspond to port guides 27, 29 of the circulator shown in FIGS. 1 and 2, with similar correspondence between waveguide flanges 25, 26 and 31. As with the front-end section 24 shown in FIGS. 1-2, the upper port guide 29 for Port 3 of this casting is seen to have a 90 degree bend. This casting would preferably also be an aluminum casting and would be copper plated, preferably electroplated, after the casting is machined. The same general fabrication processes would be followed in producing this component of the circulator as in the ferrite section, except that there is no web plate and no ferrite strips that need to be installed. Also machining the outside of this casting other than facing flanges 25, 26 and 31 is not contemplated. The casting of this part is seen to produce recesses in the casting's outer walls, such as recess 111 in the bottom of the casting.

Figure 9:
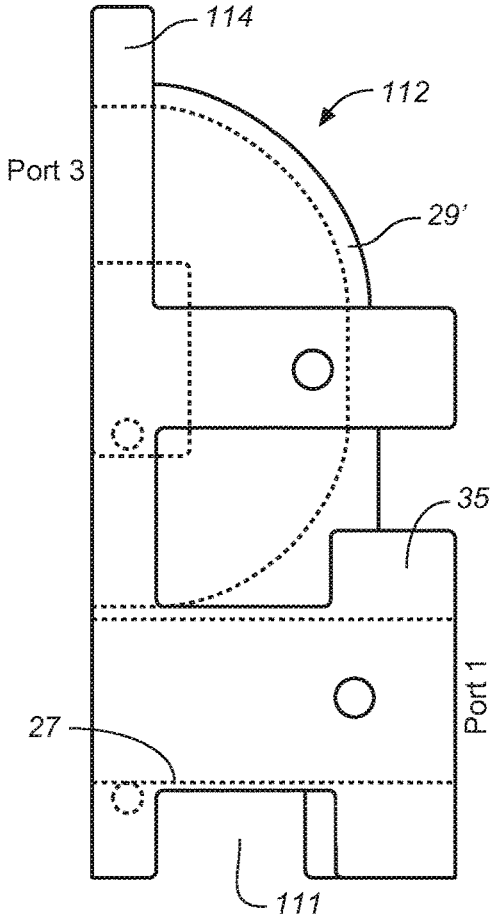
FIG. 9 is a side elevational view of another exemplary part that can be used for the two-port end section (Ports 1 and 3) of the waveguide circulator shown in FIGS. 1-4 wherein the Port 3 connector waveguide has a 180 degree bend.
Figure 9A:
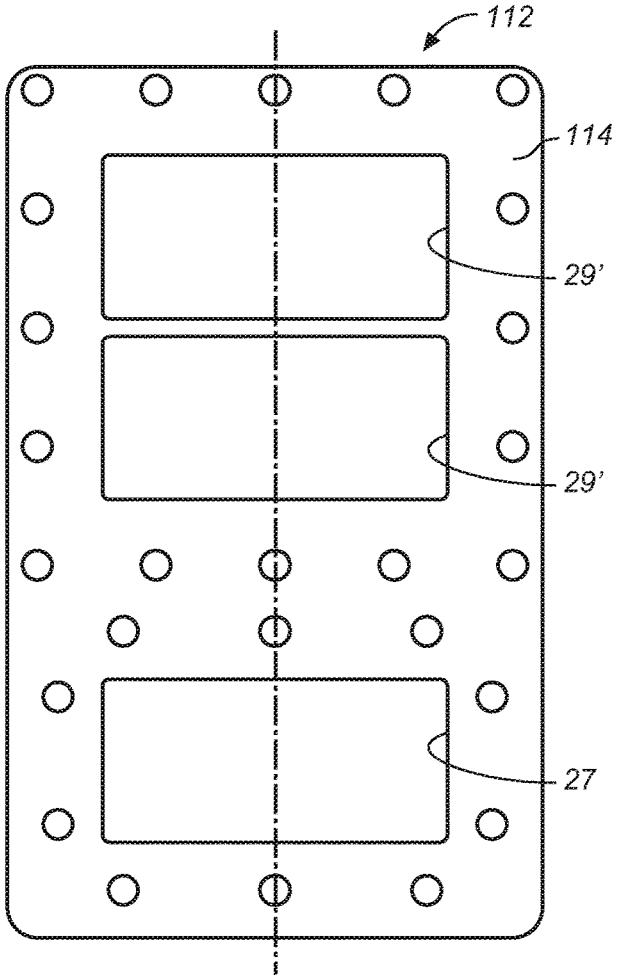
FIG. 9A is an end elevational view thereof.
Figure 9B:
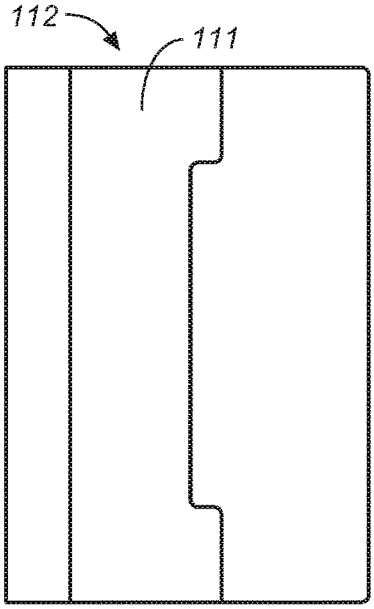
FIG. 9B is a bottom plan view thereof.

FIGS. 9, 9A and 9B illustrate an alternative version of the front-end waveguide section casting shown in FIGS. 8, 8A and 8B. In this version, the casting 112 provides for an upper port guide 29' having a 180 degree bend instead of the 90 degree bend provided in the casting illustrated in FIGS. 8, 8A and 8B. This larger bend orients Port 3 so that it faces backwards toward the bifurcated waveguide section to provide for a different attachment orientation for the load which is attached to Port 3. Also, in this version, it is seen that there are effectively only two flanges instead of three, namely, flange 25 for Port 1 and a single flange 114 for Port 3 and the end of port guide 27, which now lies in the same plane.

Figure 10:
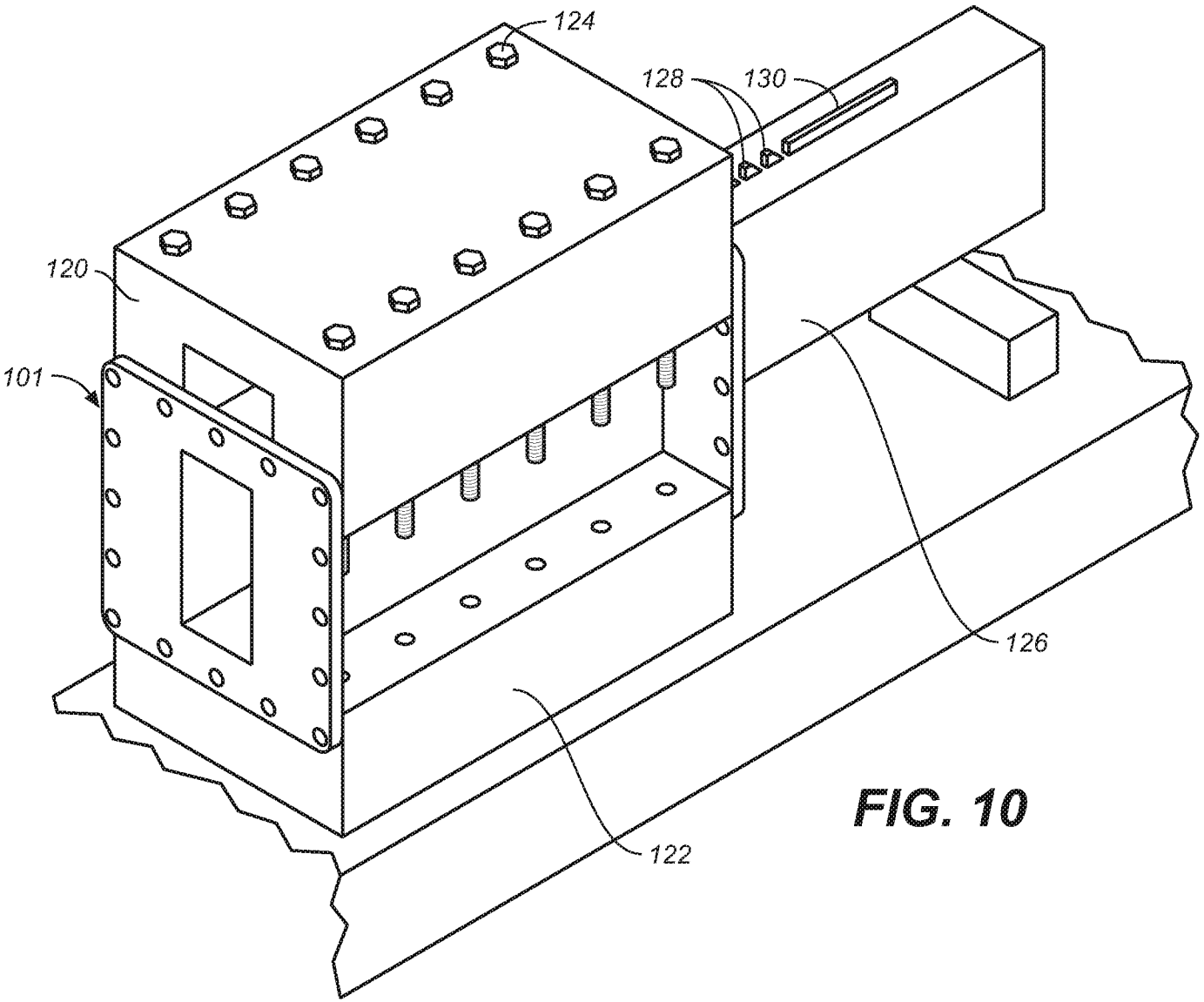
FIG. 10 is side view of an exemplary jig and cutting tool for broaching the sidewalls of the ferrite loaded waveguide section of the part shown in FIGS. 5-7.

FIG. 10 shows an exemplary jig and cutting tool for broaching the sidewalls of the casting or other part used for the bifurcated waveguide section above described. It can be seen that the casting 101 is held in a jig comprised of upper and lower clamping parts 120,122 held together by clamping bolts 124. A broaching arm 126, which is sized and shaped to slidably fit within the waveguide opening of the casting, has broaching teeth 128 distributed along its narrow top 130 for cutting a shallow broached groove in the narrow sidewall of the waveguide that faces the broaching teeth. The broaching arm can be pushed through the guide by a hydraulic ram or other suitable means. Once one sidewall is broached, the casting 101 can be flipped over in the jig to broach the other sidewall.

While the invention has been described in considerable detail in the foregoing specification in reference to the accompanying drawings, it is not intended that the invention be limited to such detail, except as may be necessitated by the claims of the application.

We claim:

1. A waveguide circulator having three ports denominated Port 1 for connecting to a microwave power source, Port 2 for connecting to a load, and Port 3 for connecting to another load for receiving reflected power from Port 2, the circulator comprising waveguide sections having waveguide flanges at the ends of the waveguides for interconnecting the waveguide sections to each other and to external power sources and external loads, the waveguide sections including a front-end waveguide section associated with Ports 1 and 3 of the circulator, a waveguide coupler section connected to the front-end waveguide section, a waveguide transformer section connected to the waveguide coupler section, a bifurcated ferrite loaded waveguide section connected to the waveguide transformer section and having an output port denominated Port 2, each of said waveguide sections and their associated waveguide flanges being non-copper metal parts having cooper plated surfaces.

2. The waveguide circulator of claim 1 wherein the parts from which waveguide sections are made are the copper plated surfaces of the non-copper metal parts are electroplated surfaces.

3. The waveguide circulator of claim 1 wherein the non-copper metal parts from which waveguide sections are made are castings.

4. The waveguide circulator of claim 1 wherein the non-copper metal parts from which waveguide sections are made are aluminum castings.

5. A ferrite loaded waveguide for a waveguide system comprised of a section of waveguide having inside guidewall surfaces, waveguide flanges at the ends of the section of waveguide, and a center web plate positioned in the section of waveguide to bifurcate the waveguide into upper and lower reduced height waveguides, wherein the section of waveguide and the waveguide flanges therefor are comprised of a single non-cooper metal part, and wherein the center web plate and at least the inside guidewall surfaces of the non-copper metal part of the ferrite loaded waveguide have copper plated surfaces.

6. The ferrite loaded waveguide of claim 5 wherein the part for the section of waveguide and waveguide flanges is a casting.

7. The ferrite loaded waveguide of claim 5 wherein the part for the section of waveguide and waveguide flanges is an aluminum casting.

8. The ferrite loaded waveguide of claim 5 wherein the inside guidewall surfaces of the part are electroplated with copper.

9. The ferrite loaded waveguide of claim 5 wherein the entire part for the waveguide and waveguide flanges is copper plated.

10. A ferrite loaded waveguide for a waveguide system comprised of a section of waveguide having inside guidewall surfaces, waveguide flanges at the ends of the section of waveguide, and a center web plate positioned in the section of waveguide to bifurcate the waveguide into upper and lower reduced height waveguides, wherein the section of waveguide and the waveguide flanges therefor are comprised of a single aluminum casting, and wherein the center web plate and at least the inside guidewall surfaces of the parts have a coating of electroplated copper.

11. The ferrite loaded waveguide of claim 10 wherein the inside guide wall surfaces are plated with a copper coating which is at least about 2 mils thick.

12. A method of making a ferrite loaded waveguide section of a waveguide system wherein the ferrite loaded waveguide section is comprised of a waveguide having top and bottom broadwalls, sidewalls and inside guidewall surfaces, a copper plated web plate positioned in the waveguide to bifurcate the waveguide into upper and lower reduced height waveguides, and waveguide flanges at the ends of the waveguide, and wherein the method comprises:

producing a part in the form of a waveguide section having waveguide flanges at the ends of the part, machining the part, broaching sidewalls of the waveguide to produce broach grooves therein for receiving the copper plated web plate, copper plating at least the inside guidewall surfaces of the part, positioning the copper plated web plate in the broach grooves in the waveguide sidewalls, soldering the web plate in the waveguide of the part, and attaching ferrite strips to the broadwalls of the waveguide of the part.

13. The method of claim 12 wherein the casting for the waveguide and waveguide flanges is an aluminum casting.

14. The method of claim 12 wherein the entire part is copper plated.

15. The method of claim 12 wherein the step of copper plating at least the inside guidewall surfaces of the part is achieved by electroplating.

16. The method of claim 15 wherein the inside guide wall surfaces are plated with a copper coating which is at least about 2 mils thick.

17. A method of making a ferrite loaded waveguide section of a waveguide system wherein the ferrite loaded waveguide section is comprised of a waveguide having top and bottom broadwalls, sidewalls and inside guidewall surfaces, a copper plated web plate positioned in the waveguide to bifurcate the waveguide into upper and lower reduced height waveguides, and waveguide flanges at the ends of the waveguide, and wherein the method comprises:

producing an aluminum casting in the form of a waveguide section having waveguide flanges at the ends of the casting, machining the casting, broaching sidewalls of the waveguide to produce shallow broach grooves therein for receiving the copper plated web plate, electroplating the casting, positioning the copper plated web plate in the shallow broach grooves in the waveguide sidewalls, soldering the web plate in the waveguide of the casting, and attaching ferrite strips to the broadwalls of the waveguide of the casting after the web plate has been soldered in place.

* * * * *